US010208647B2

(12) United States Patent
Okita et al.

(10) Patent No.: US 10,208,647 B2
(45) Date of Patent: Feb. 19, 2019

(54) SADDLE-RIDDEN TYPE VEHICLE

(71) Applicant: SUZUKI MOTOR CORPORATION, Hamamatsu-shi, Shizuoka (JP)

(72) Inventors: Kazuhiro Okita, Hamamatsu (JP); Takaya Suzuki, Hamamatsu (JP); Shintaro Yagi, Hamamatsu (JP)

(73) Assignee: SUZUKI MOTOR CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/298,926

(22) Filed: Oct. 20, 2016

(65) Prior Publication Data

US 2017/0114706 A1 Apr. 27, 2017

(30) Foreign Application Priority Data

Oct. 27, 2015 (JP) ..... 2015-210457

(51) Int. Cl.

| | |
|---|---|
| ***F01P 11/04*** | (2006.01) |
| ***F01P 3/12*** | (2006.01) |
| ***F01P 3/18*** | (2006.01) |
| ***F01P 5/10*** | (2006.01) |
| ***F01P 7/14*** | (2006.01) |
| ***F01P 11/08*** | (2006.01) |
| ***F02F 1/10*** | (2006.01) |
| ***F01P 5/04*** | (2006.01) |

(52) U.S. Cl.

CPC ..... *F01P 11/04* (2013.01); *F01P 3/12* (2013.01); *F01P 3/18* (2013.01); *F01P 5/04* (2013.01); *F01P 5/10* (2013.01); *F01P 7/14* (2013.01); *F01P 11/08* (2013.01); *F02F 1/10* (2013.01); *F01P 2050/16* (2013.01)

(58) Field of Classification Search

CPC ..... F01P 11/04; F01P 3/18; F01P 3/12; F01P 7/14; F01P 11/08; F01P 5/10; F01F 1/10

See application file for complete search history.

(56) References Cited

U.S. PATENT DOCUMENTS

2003/0017765 A1* 1/2003 Gokan ..... F01M 1/02 440/88 L

2014/0060465 A1* 3/2014 Iida ..... F02B 61/02 123/41.47

FOREIGN PATENT DOCUMENTS

JP 2007-85264 A 4/2007

* cited by examiner

*Primary Examiner* — Jacob Amick
*Assistant Examiner* — Charles Brauch
(74) *Attorney, Agent, or Firm* — Stein IP, LLC

(57) ABSTRACT

There is provided a saddle-ridden type vehicle. A cooling water flow control unit includes a first passage, a second passage, a bypass passage communicating the first and second passages and a thermostat. An engine outlet piping connects a water jacket and the first passage. A radiator inlet piping connects the first passage and a radiator. A radiator outlet piping connects the radiator and the second passage. A water pump inlet piping connects the second passage and a water pump. The water pump is disposed at a side part of a crank case and in front of a crankshaft. The cooling water flow control unit is disposed above a cylinder head cover. The radiator inlet piping, the radiator outlet piping and the water pump inlet piping are disposed between the engine and the radiator.

6 Claims, 13 Drawing Sheets

SADDLE-RIDDEN TYPE VEHICLE

CROSS-REFERENCE TO RELATED APPLICATIONS

The disclosure of Japanese Patent Application No. 2015-210457 filed on Oct. 27, 2015, including specification, drawings and claims is incorporated herein by reference in its entirety.

TECHNICAL FIELD

The disclosure relates to a saddle-ridden type vehicle having an engine and a water-cooling type cooling device configured to cool the engine.

BACKGROUND

A saddle-ridden type vehicle such as a motorcycle has an engine and a cooling device configured to cool the engine. When the engine is a water-cooling type engine, the saddle-ridden type vehicle is provided with a variety of components, as cooling system components configuring the cooling device, as follows.

That is, the saddle-ridden type vehicle is provided with a water pump configured to discharge cooling water, a water jacket configured to flow the cooling water around a cylinder and a cylinder head of the engine and to thereby cool the cylinder and the cylinder head, and a radiator configured to cool the cooling water, of which temperature has increased resulting from the cooling of the cylinder and the cylinder head, by traveling wind. In addition, the saddle-ridden type vehicle is provided with a thermostat configured to switch a circulation path of the cooling water, which is to be discharged from the water pump, to flow in the water jacket and then to return to the water pump without flowing in the radiator, and a circulation path of the cooling water, which is to be discharged from the water pump, to flow in the water jacket and the radiator and then to return to the water pump.

Also, in order to form the two circulation paths, a piping configured to supply the cooling water from the water pump to the water jacket is provided between a discharge port of the water pump and an inlet of the water jacket, a piping configured to deliver the cooling water from the water jacket to the radiator is provided between an outlet of the water jacket and an inlet of the radiator, and a piping configured to return the cooling water from the radiator to the water pump is provided between an outlet of the radiator and an intake port of the water pump. In addition, a bypass piping configured to return the cooling water from the water jacket to the water pump without flowing the cooling water in the radiator is provided between the outlet of the water jacket and the intake port of the water pump.

For example, in a motorcycle disclosed in Patent Document 1, the above-described cooling system components are disposed as follows. That is, when describing front, rear, right, left, upper and lower directions on the basis of a driver sitting on a seat of the motorcycle, the water pump is attached to a rear-lower part of a left side of the engine, as shown in FIGS. 2 to 5 of Patent Document 1. Also, the cooling water inlet of the water jacket is disposed at a front part of the engine, and the cooling water outlet is disposed at a rear part of the engine. Also, the radiator is disposed at the front of the engine, and the cooling water inlet of the radiator is disposed at a right part of the radiator and the cooling water outlet is disposed at a left part of the radiator. Also, the radiator adapted for the motorcycle is a so-called transverse flow type. The cooling water is enabled to flow in a right-left direction (in the example, from right to left) in the radiator and is thus cooled. Also, the thermostat is disposed at the rear part of the engine, and is directly connected to the cooling water outlet of the water jacket.

Also, in the motorcycle disclosed in Patent Document 1, the piping (cylinder inlet hose) configured to connect the discharge port of the water pump and the inlet of the water jacket extends over a range from the rear-lower part of the left side of the engine to the front part of the engine. Also, the piping (radiator inlet hose) configured to connect the thermostat directly connected to the outlet of the water jacket and the inlet of the radiator extends from the rear part of the engine toward the front of the engine through the right side of the engine. Also, the piping (radiator outlet hose) configured to connect the outlet of the radiator and the intake port of the water pump extends from the left part of the radiator toward the rear-lower part of the left side of the engine. Also, the left part of the radiator is formed with a separate inlet above the cooling water outlet, and the separate inlet is in communication with the outlet of the radiator without interposing a radiator core. Also, the bypass piping (bypass hose) is connected between the inlet and the thermostat directly connected to the outlet of the water jacket, and extends from the rear part of the engine toward the front of the engine through the left side of the engine.

Patent Document 1: Japanese Patent Application Publication No. 2007-85264A

In the saddle-ridden type vehicle of the related art, the pipings configured to connect the cooling system components such as the water pump, the water jacket, the radiator and the like may traverse laterally the engine. For example, in the motorcycle disclosed in Patent Document 1, the radiator inlet hose traverses a right side of the cylinder and the bypass hose traverses a left side of the cylinder head.

When it is intended to improve a design property of the saddle-ridden type vehicle, an outward appearance of the engine as seen from a side is important. When the piping traverses laterally the cylinder or cylinder head of the engine, the outward appearance of the engine as seen from a side is deteriorated, so that the design property of the saddle-ridden type vehicle may be lowered.

Also, in order to implement a lightsome handling property of the saddle-ridden type vehicle (mainly, a motorcycle), it is preferably to make a vehicle width of the saddle-ridden type vehicle small. However, when the piping is configured to traverse laterally the engine, it is difficult to make the vehicle width of the saddle-ridden type vehicle small.

Also, when the piping is configured to traverse laterally the engine, it is difficult for the traveling wind to collide with the engine, so that cooling performance of the engine may be lowered.

Also, when the piping is configured to traverse laterally the engine or when the pipings are dispersedly distributed at the right and left sides of the engine, it is difficult to secure a space in which other components relating to the engine are to be disposed.

SUMMARY

The disclosure has been made in view of the above situations, and an object of the disclosure is to provide a saddle-ridden type vehicle capable of improving a design property and a handling property of the saddle-ridden type vehicle or cooling performance of an engine and easily securing an arrangement space for components to be provided in the engine.

According to an aspect of the embodiments of the present invention, there is provided a saddle-ridden type vehicle comprising: an engine in which a cylinder and a cylinder head are provided above a crank case and a cylinder head cover is provided above the cylinder head; a water pump configured to discharge cooling water; a water jacket provided in the engine and configured to cool the engine by the cooling water discharged from the water pump; a radiator disposed in front of the engine and configured to cool the cooling water having cooled the engine; a cooling water flow control unit having a first passage through which the cooling water having cooled the engine flows from the water jacket to the radiator, a second passage through which the cooling water having flowed in the radiator flows from the radiator to the water pump, a bypass passage communicating the first passage and the second passage each other and a thermostat configured to control a flow rate of the cooling water flowing in the radiator; an engine outlet piping connecting an outlet of the water jacket and an inlet of the first passage of the cooling water flow control unit therebetween; a radiator inlet piping connecting an outlet of the first passage of the cooling water flow control unit and an inlet of the radiator therebetween; a radiator outlet piping connecting an outlet of radiator and an inlet of the second passage of the cooling water flow control unit therebetween; and a water pump inlet piping connecting an outlet of the second passage of the cooling water flow control unit and an intake port of the water pump therebetween, wherein the water pump is disposed at a side part of the crank case and in front of a crankshaft of the engine, wherein the cooling water flow control unit is disposed above the cylinder head cover, and wherein the radiator inlet piping, the radiator outlet piping and the water pump inlet piping are disposed between the engine and the radiator.

According to the above aspect of the disclosure, it is possible to concentrate the radiator inlet piping, the radiator outlet piping and the water pump inlet piping between the engine and the radiator. Therefore, it is possible to prevent the radiator inlet piping, the radiator outlet piping or the water pump inlet piping from traversing laterally the engine. Therefore, it is possible to improve a design property of the saddle-ridden type vehicle. Also, it is possible to improve a handling property of the saddle-ridden type vehicle by reducing a vehicle width. Also, the cooling wind can easily collide with a side surface of the engine, so that it is possible to increase cooling performance of the engine. Also, it is possible to easily secure an arrangement space for components to be provided in the engine.

In the saddle-ridden type vehicle, the cooling water flow control unit may be disposed above a front edge portion of an upper surface of the cylinder head cover.

According to the above aspect of the disclosure, it is possible to dispose the cooling water flow control unit in the front of the engine. Thereby, it is possible to easily concentrate the radiator inlet piping, the radiator outlet piping and the water pump inlet piping between the engine and the radiator.

In the saddle-ridden type vehicle, the cooling water flow control unit may be disposed in front of an axis line of the cylinder, when the engine is seen from a side.

Also by the above aspect of the disclosure, it is possible to dispose the cooling water flow control unit in the front of the engine. Thereby, it is possible to easily concentrate the radiator inlet piping, the radiator outlet piping and the water pump inlet piping between the engine and the radiator.

In the saddle-ridden type vehicle, the water pump may be disposed in front of an axis line of the cylinder, when the engine is seen from a side.

According to the above aspect of the disclosure, it is possible to dispose the water pump in the front of the engine. Thereby, it is possible to easily dispose the water pump inlet piping between the engine and the radiator.

In the saddle-ridden type vehicle, the water pump and the cooling water flow control unit may be both disposed at one side deviating from a center of the engine in a right-left direction.

According to the above aspect of the disclosure, the water pump and the cooling water flow control unit are disposed at one side in the right-left direction of the engine. Thereby, it is possible to dispose the entire water pump inlet piping at one side in the right-left direction of the engine, to entirely dispose one of the radiator inlet piping and the radiator outlet piping at one side in the right-left direction of the engine, to dispose a part of the other of the radiator inlet piping and the radiator outlet piping at one side in the right-left direction of the engine and to entirely or partially dispose the engine outlet piping at one side in the right-left direction of the engine. As a result, it is possible to concentrate the radiator inlet piping, the radiator outlet piping, the water pump inlet piping and the engine outlet piping at one side in the right-left direction of the engine. Therefore, it is possible to form a large empty space at other side in the right-left direction of the engine, so that it is possible to easily secure an arrangement space for the components to be provided in the engine.

In the saddle-ridden type vehicle, a supercharger or an oil cooler may be provided at the front of the engine, a discharge port of the water pump and a cooling water inlet of the supercharger or the oil cooler may be connected by an inlet branch piping, a cooling water outlet of the supercharger or the oil cooler and the inlet of the first passage of the cooling water flow control unit may be connected by an outlet branch piping, and the inlet branch piping and the outlet branch piping may be disposed between the engine and the radiator.

According to the above aspect of the disclosure, the inlet branch piping and the outlet branch piping configured to flow the cooling water in the oil cooler are provided or when the engine is provided with the supercharger, the inlet branch piping and the outlet branch piping configured to flow the cooling water in the supercharger are disposed between the engine and the radiator. Thereby, it is possible to prevent the corresponding pipings from traversing laterally the engine and to concentrate the corresponding pipings between the engine and the radiator together with the radiator inlet piping, the radiator outlet piping and the water pump inlet piping.

According to the disclosure, it is possible to improve the design property and handling property of the saddle-ridden type vehicle and the cooling performance of the engine and to easily secure the arrangement space for the components to be provided in the engine.

DETAILED DESCRIPTION OF THE EMBODIMENTS (Motorcycle Having Supercharger)

Figure 1:
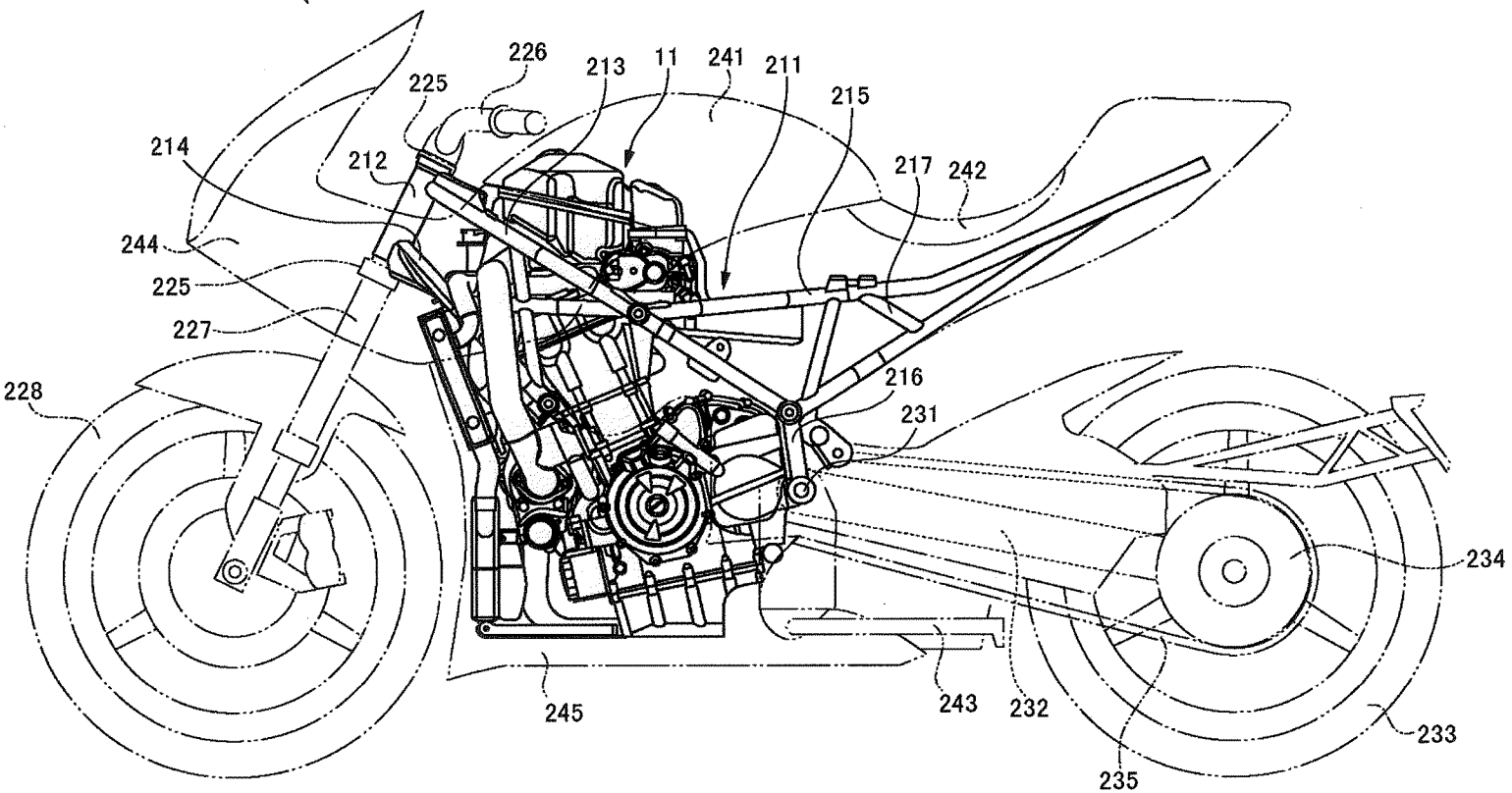
FIG. 1 illustrates a motorcycle having a supercharger, which is an illustrative embodiment of the saddle-ridden type vehicle of the disclosure.

FIG. 1 illustrates a motorcycle having a supercharger, which is an illustrative embodiment of the saddle-ridden type vehicle of the disclosure. In FIG. 1, parts except for a vehicle body frame and an engine unit of the motorcycle having the supercharger are shown with a dashed-two dotted line for convenience of explanations. Also, in below descriptions of the illustrative embodiment, front, rear, right, left, upper and lower directions are described on the basis of a driver who sits on a seat of the motorcycle having the supercharger.

In FIG. 1, a vehicle body frame 211 of a motorcycle 1 having a supercharger, which is an illustrative embodiment of the saddle-ridden type vehicle of the disclosure, is formed by joining a plurality of steel pipes, for example. Specifically, the vehicle body frame 211 has a head pipe 212 disposed at a front-upper side of the motorcycle 1, a pair of main frames 213 each of which is disposed at right and left sides of the motorcycle 1, respectively, and has a front end portion connected to an upper part of the head pipe 212 and a rear end-side extending rearward with being inclined downward, a pair of down tubes 214 each of which is disposed at the right and left sides of the motorcycle 1, respectively, and has a front end portion connected to a lower part of the head pipe 212 and a rear end-side extending rearward with being more inclined downward than the main frame 213, a pair of side frames 215 each of which is disposed at the right and left sides of the motorcycle 1, respectively, and has a front end portion connected to an intermediate part of the down tube 214 and a rear end-side extending rearward, and a pair of pivot frames 216 joined to the rear end-sides of the main frames 213. Also, a reinforcement frame 217 is provided among the main frame 213, the down tube 214 and the side frame 215.

Also, a steering shaft (not shown) is inserted into the head pipe 212, and upper and lower end portions of the steering shaft are respectively provided with steering brackets 225. The upper steering bracket 225 is provided with a handlebar 226. A pair of right and left front forks 227 is supported at upper parts thereof to the upper and lower steering brackets 225, and a front wheel 228 is supported to lower ends of the front forks 227.

Also, a front end-side of a swing arm 232 is supported between the pair of right and left pivot frames 216 via a pivot shaft 231, and a rear wheel 233 is supported to a rear end-side of the swing arm 232. Also, an axle of the rear wheel 233 is provided with a driven sprocket 234, and a chain 235 configured to transmit power of an engine 12 (which will be described later) is wound on the driven sprocket 234.

Also, an engine unit 11 is provided between the front wheel 228 and the rear wheel 233 of the motorcycle 1. The engine unit 11 is mainly disposed between the left main frame 213 and left down tube 214 and the right main frame 213 and right down tube 214 and is supported to the corresponding frames. Also, a fuel tank 241 is provided above the engine unit 11, and a seat 242 is provided at the rear of the fuel tank 241. Also, a side stand 243 is provided at the left side of the motorcycle 1 and at a lower-rear part of the engine unit 11. Also, an upper cowl 244 is provided at a front-upper side of the motorcycle 1. Also, the motorcycle 1 is provided with an under cowl 245 configured to mainly cover a front-lower side of the engine unit 11.

(Engine Unit)

Figure 2:
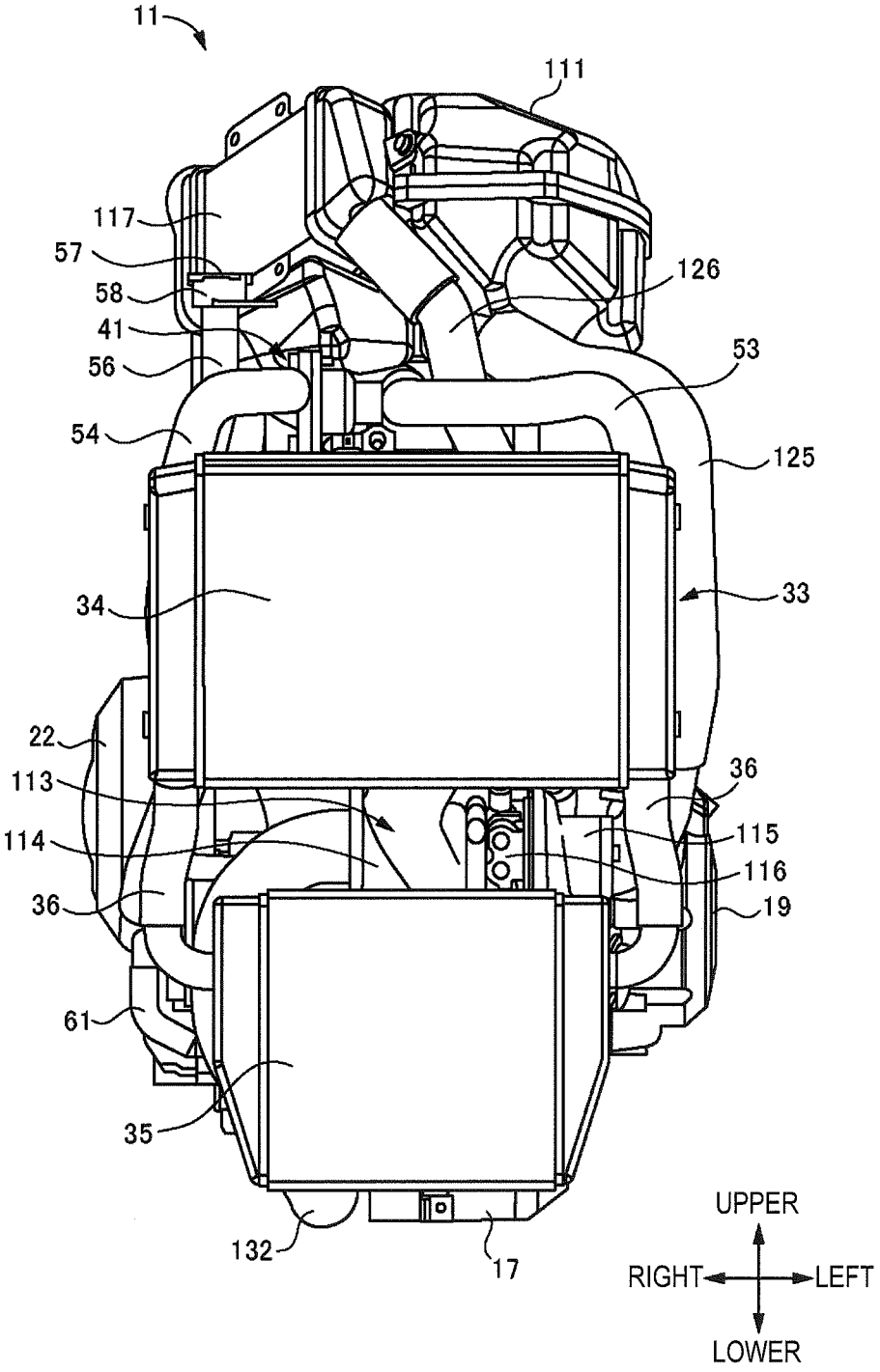
FIG. 2 is a front view of an engine unit of the motorcycle having a supercharger, which is the illustrative embodiment of the saddle-ridden type vehicle of the disclosure.
Figure 3:
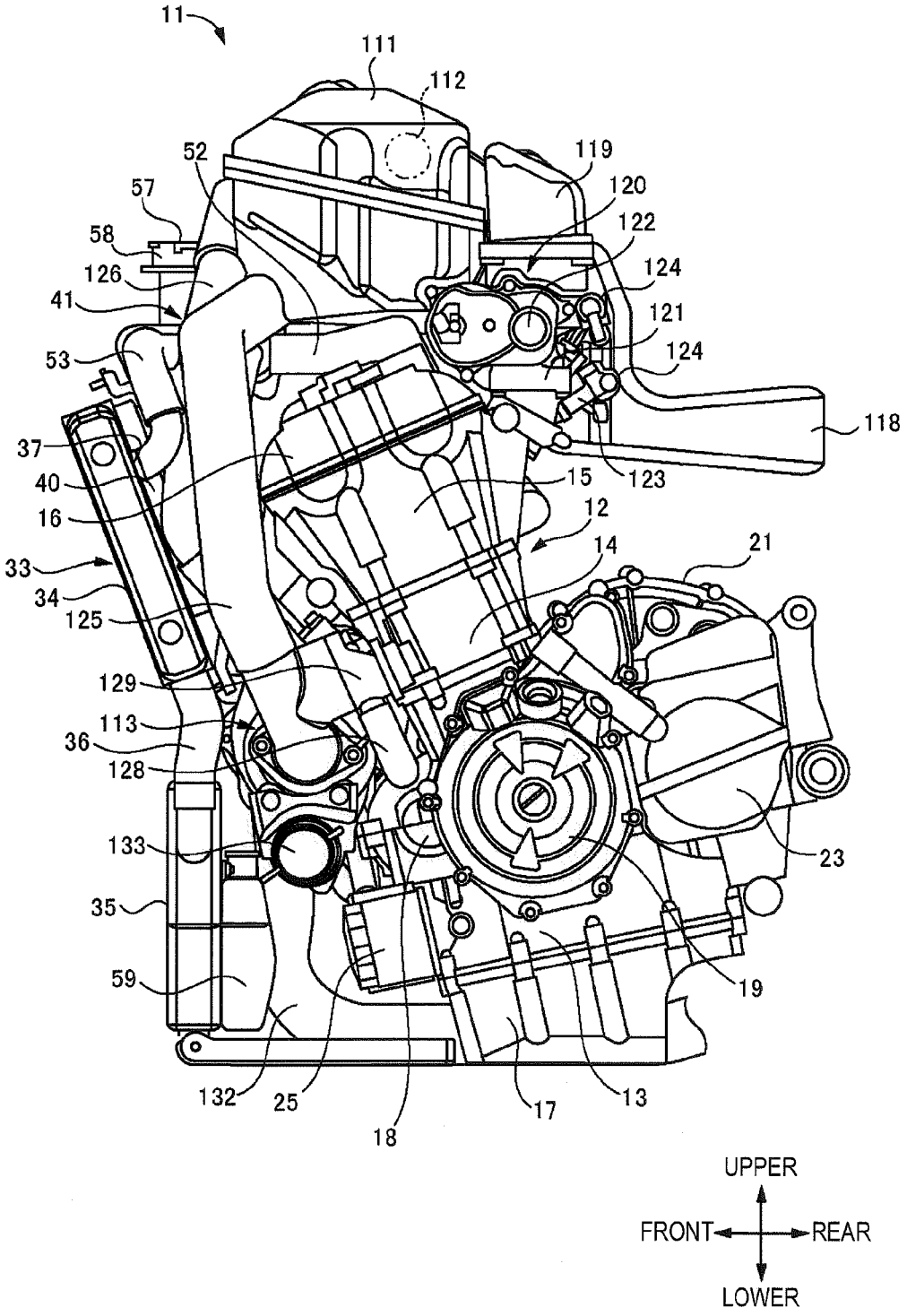
FIG. 3 is a left side view of the engine unit shown in FIG. 2.
Figure 4:
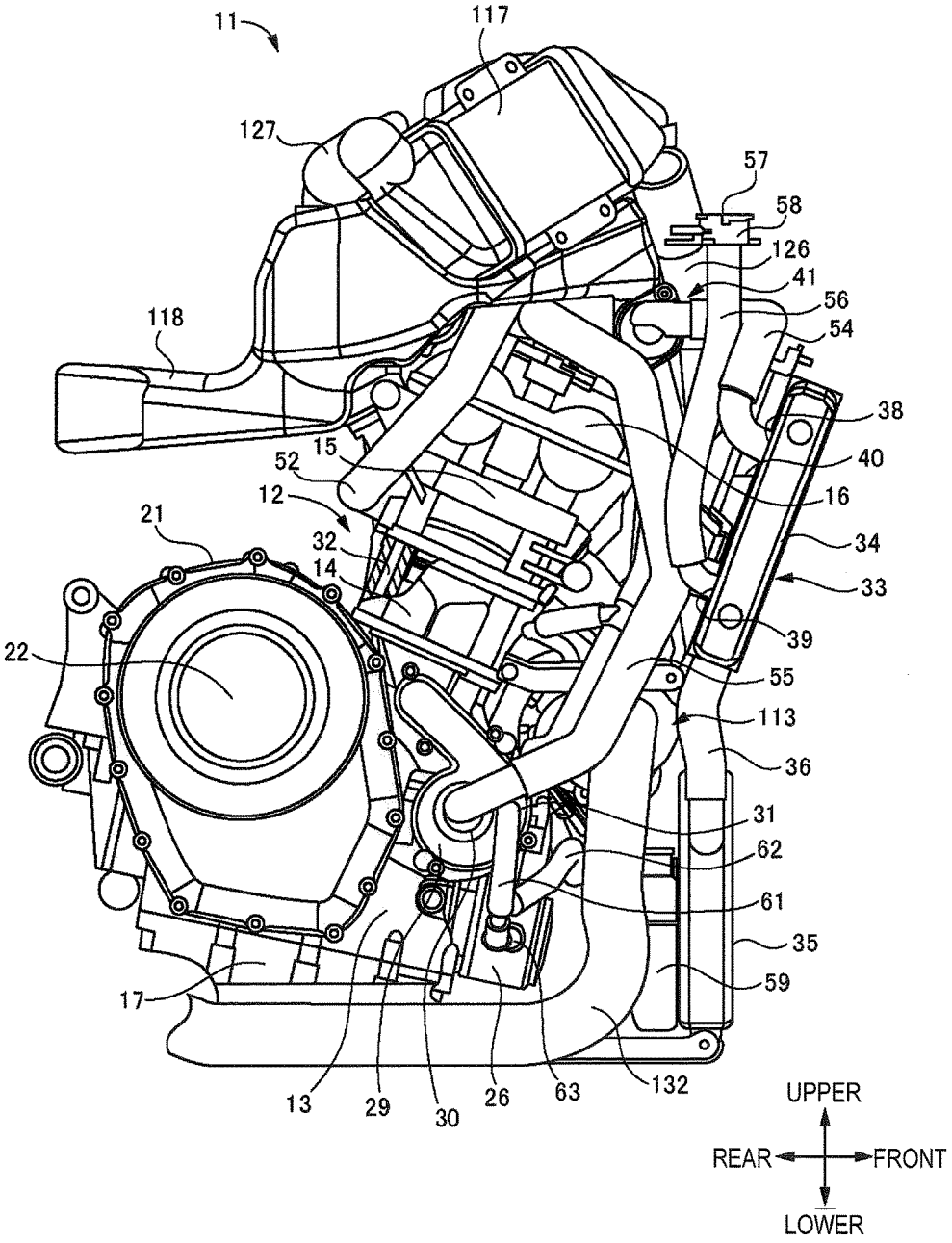
FIG. 4 is a right side view of the engine unit shown in FIG. 2.
Figure 5:
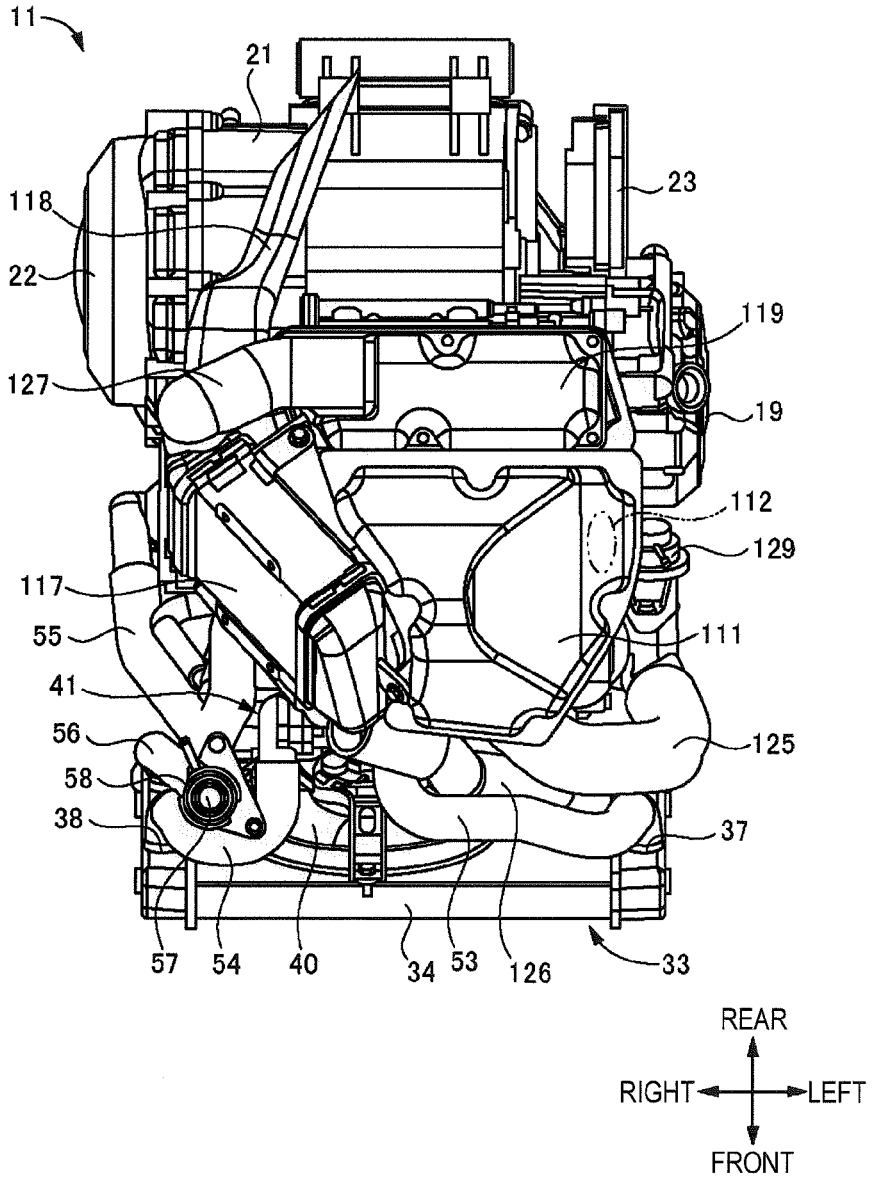
FIG. 5 is a plan view of the engine unit shown in FIG. 2.
Figure 6:
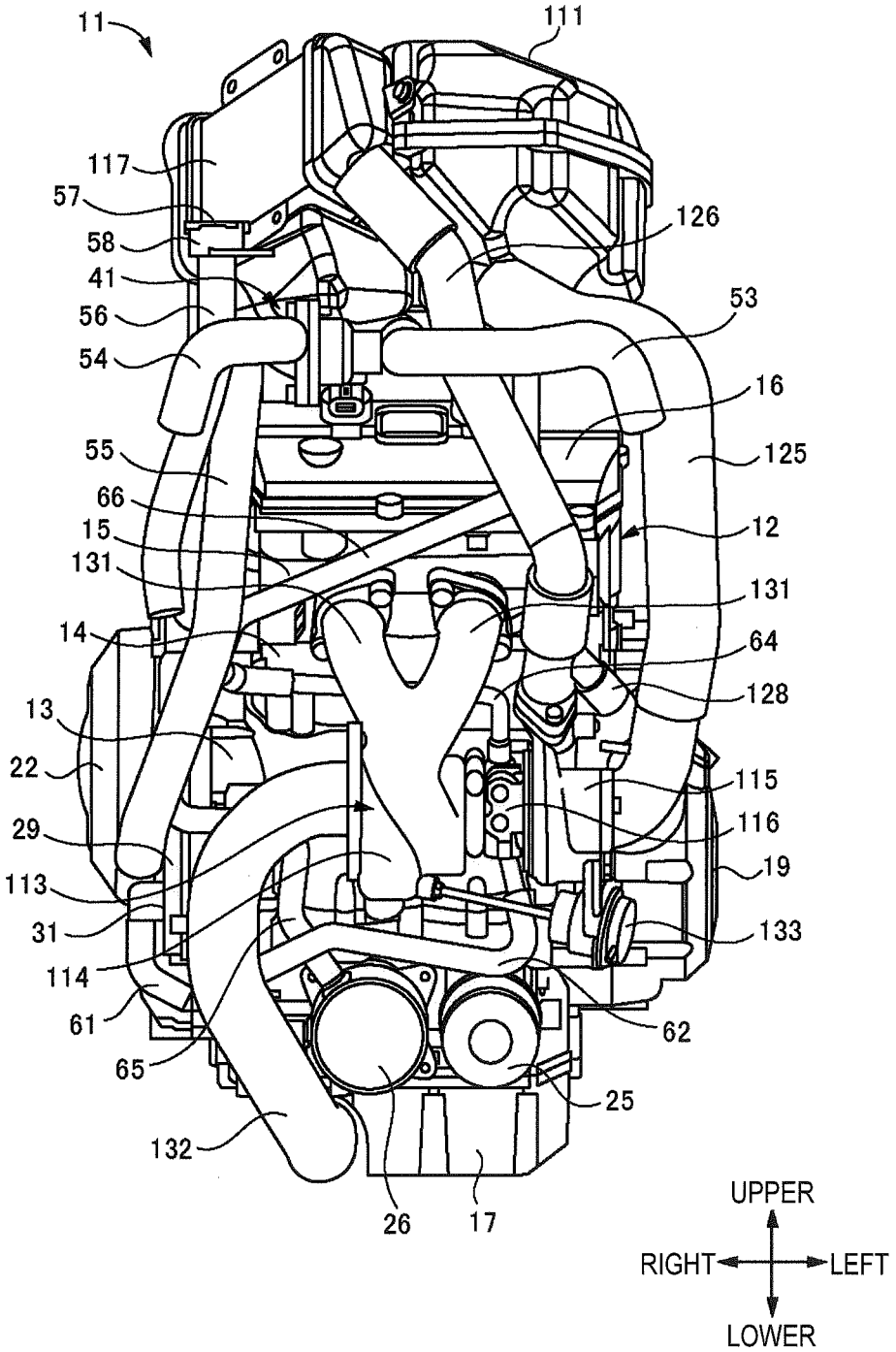
FIG. 6 is a front view depicting a state where a radiator has been removed from the engine unit shown in FIG. 2.
Figure 7:
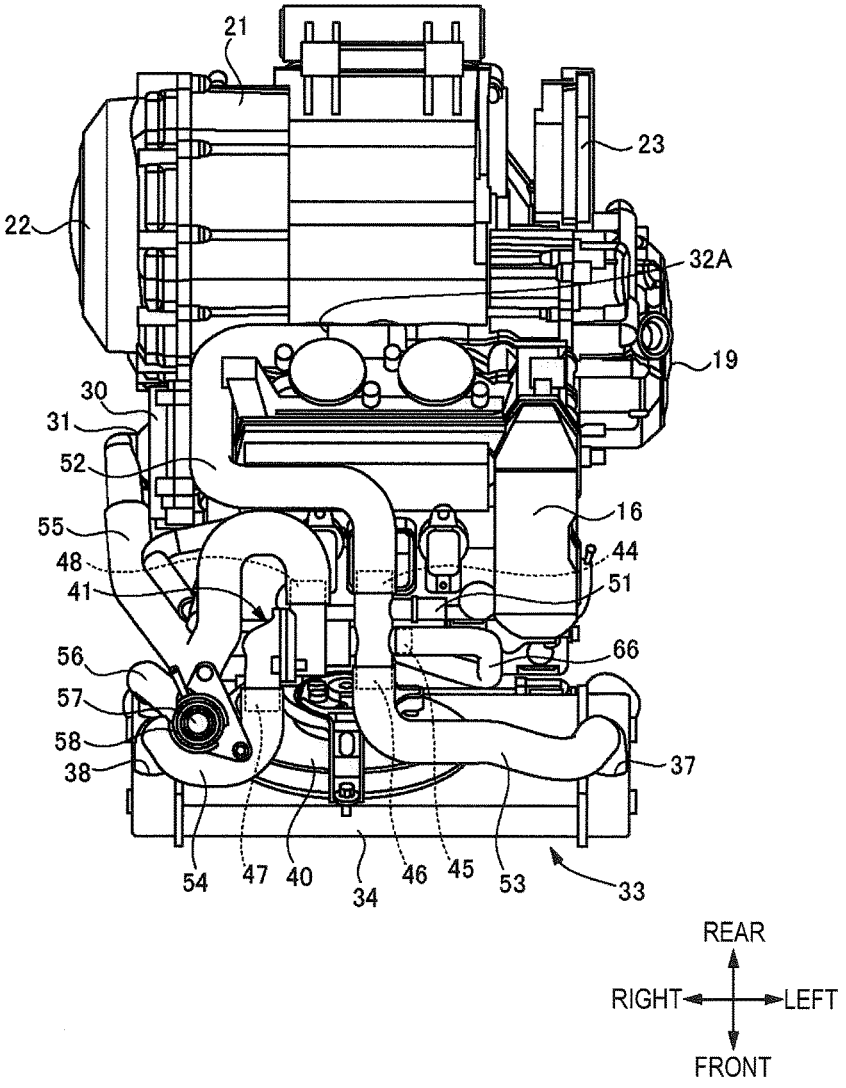
FIG. 7 is a plan view depicting a state where an air cleaner, an intercooler, a surge tank and the like have been removed from the engine unit shown in FIG. 5.

FIGS. 2 to 5 are a front view, a left side view, a right side view and a plan view of the engine unit 11. FIG. 4 is a partially cutout view of the cylinder. Also, FIG. 6 is a front view depicting a state where a radiator 33 has been removed from the engine unit 11. FIG. 7 is a plan view depicting a state where an air cleaner 111, an intercooler 117 and a surge tank 119 have been removed from the engine unit 11.

As shown in FIG. 3, the engine unit 11 has an engine 12, parts of a driving system configured to transmit power of the engine 12 to the rear wheel 233, such as a primary deceleration mechanism, a clutch, a transmission and the like, a lubrication system configured to lubricate a moveable part of the engine 12, an intake system (including a supercharger 113) configured to supply a fuel-air mixture of air and fuel to the engine 12, parts of an exhaust system configured to discharge an exhaust gas, which is to be generated as the fuel-air mixture is combusted, from the engine 12, a cooling system configured to cool the engine 12 and the like, an AC generator configured to generate power by using rotation of a crankshaft, and the like.

In the illustrative embodiment, the engine 12 is a water-cooling type parallel two-cylinder four-cycle gasoline engine, for example. The engine 12 has a crank case 13 configured to accommodate therein a crankshaft, a cylinder 14 provided above the crank case 13, a cylinder head 15 provided above the cylinder 14 and a cylinder head cover 16 provided above the cylinder head 15. Also, an oil pan 17 is provided below the crank case 13. A cylinder axis of the engine 12 is inclined so that an upper side is located at a more forward position than a lower side. The engine 12 is provided with a balance shaft configured to reduce vibrations, which are to be generated by movement of a piston. The balance shaft is disposed in front of the crankshaft. Specifically, a balancer chamber 18 is integrally formed at a front part of the crank case 13 of the engine 12. The balancer chamber 18 is formed by expanding forward a part of the crank case 13. A front part of the balancer chamber 18 protrudes forward from a front wall part of the crank case 13. The balance shaft is provided in the balancer chamber 18. A left part of the crank case 13 is provided with a magneto chamber 19, and the AC generator is accommodated in the magneto chamber 19.

Also, as shown in FIG. 4, parts of the driving system such as the primary deceleration mechanism, the clutch, the transmission and the like are disposed at the rear part of the engine 12. That is, a transmission case 21 is integrally formed at rear sides of the crank case 13 and the cylinder 14, and the primary deceleration mechanism and the transmission are accommodated in the transmission case 21. Also, a clutch cover 22 is attached to a right part of the transmission case 21, and the clutch disposed at the right of the transmission is covered by the clutch cover 22. Also, as shown in FIG. 3, a sprocket cover 23 is provided at a left part of the transmission case 21, and a drive sprocket disposed at a left side of the transmission is covered by the sprocket cover 23. Also, the drive sprocket is wound with a chain 235 configured to transmit the power of the engine 12 to the rear wheel 233, as shown in FIG. 1.

Also, as shown in FIG. 6, the lubrication system has an oil pump configured to pump engine oil stored in the oil pan 17 of the engine 12 and to supply the same to the respective parts of the engine 12, an oil filter 25 configured to filter the engine oil and a water-cooling type oil cooler 26 configured to cool the engine oil. The oil filter 25 and the oil cooler 26 are attached to a front-lower side of the engine 12.

Also, as shown in FIG. 3 or 6, the intake system has an air cleaner 111, a supercharger 113, an intercooler 117, an air discharging duct 118, a surge tank 119, an electronic control throttle device 120 and an injector 123. The air cleaner 111 is a device configured to filter air introduced from an outside, and has therein an air filter. The supercharger 113 is a device having a turbine unit 114, a compressor unit 115 and a bearing unit 116 and configured to drive the turbine unit 114 by the exhaust gas from the engine 12, to drive the compressor unit 115 by the driving and to compress the air supplied through the air cleaner 111 by the compressor unit 115. In the meantime, the bearing unit 116 is a part configured to accommodate therein a bearing configured to rotatably support a turbine wheel provided in the turbine unit 114 and a compressor impeller provided in the compressor unit 115. The intercooler 117 is a device configured to cool the air of which temperature has increased resulting from the compression by the compressor unit 115 of the supercharger 113. As shown in FIG. 5, the air discharging duct 118 configured to discharge cooling wind having collided with the intercooler 117 to the outside is provided in the vicinity of the intercooler 117. The surge tank 119 is a device configured to rectify the flow of the air cooled by the intercooler 117. The electronic control throttle device 120 shown in FIG. 3 is a device configured to regulate an amount of the air, which is to pass through the intercooler 117 and is to be supplied to an intake port of the engine 12. The electronic control throttle device 120 has a throttle body 121, a throttle valve provided in the throttle body 121 and configured to open and close an intake passage formed in the throttle body 121, and a driving motor 122 configured to drive the throttle valve. The injector 123 is a device configured to inject the fuel to the intake port of the engine 12. To the injector 123, a delivery pipe 124 configured to supply the fuel from the fuel tank 241 to the injector 123 is connected.

The respective parts configuring the intake system are disposed and connected as follows. That is, as shown in FIG. 6, the air cleaner 111 is disposed at an upper-left side of the engine 12. The supercharger 113 is disposed at the front of the engine 12, specifically, at the front of the cylinder 14 and the cylinder head 15. The air cleaner 111 and the compressor unit 115 of the supercharger 113 are connected therebetween by an air intake pipe 125, and the air intake pipe 125 is disposed at a front-left side of the engine 12. Also, the intercooler 117 is disposed at an upper-right side of the engine 12. The compressor unit 115 of the supercharger 113 and the intercooler 117 are connected therebetween by an air outlet pipe 126, and the air outlet pipe 126 is disposed at a front-left side of the engine 12 and at a right side of the air intake pipe 125. Also, as shown in FIG. 5, the surge tank 119 is disposed at an upper-rear side of the engine 12. The intercooler 117 and the surge tank 119 are connected therebetween by a connecting pipe 127. The connecting pipe 127 is disposed at a right-rear side above the engine 12. Also, as shown in FIG. 3, the throttle body 121 of the electronic control throttle device 120 is disposed between the surge tank 119 and the intake port of the engine 12 at a rear-upper side of the engine 12.

The air introduced from the outside normally sequentially passes through the air cleaner 111, the air intake pipe 125, the compressor unit 115 of the supercharger 113, the air outlet pipe 126, the intercooler 117, the connecting pipe 127, the surge tank 119 and the throttle body 121 of the electronic control throttle device 120, and is then supplied to the intake port of the engine 12.

Also, as shown in FIG. 3, an air bypass passage 128 configured to connect the air intake pipe 125 and the air outlet pipe 126 without interposing the compressor unit 115 of the supercharger 113 is provided in the vicinity of the compressor unit 115 of the supercharger 113, and an air bypass valve 129 configured to switch communication and cutoff of the air bypass passage 128 is provided on the way of the air bypass passage 128.

Meanwhile, in FIG. 3 or 5, an intake port 112 of the air cleaner 111 is pictorially shown with a dashed-two dotted line. However, the position of the intake port 112 can be appropriately set. Also, the intake port 112 is provided with an air duct configured to guide the exterior air to the intake port 112. However, the air duct is not shown.

Also, as shown in FIG. 6, the exhaust system has exhaust pipes 131 configured to connect exhaust ports of the engine 12 and the turbine unit 114 of the supercharger 113 therebetween, a muffler joint pipe 132 configured to connect the turbine unit 114 of the supercharger 113 and a muffler-side, a muffler (not shown), and the like. The exhaust pipes 131 configure a part of the engine unit 11. The exhaust pipes 131 are disposed at the front of the engine 12 and between the exhaust ports and the turbine unit 114 of the supercharger 113. In the illustrative embodiment, the exhaust pipes 131 are integrally formed with a housing of the turbine unit 114 of the supercharger 113. Specifically, one end-sides of the two exhaust pipes 131 are respectively connected to the two exhaust ports of the parallel two-cylinder engine 12. The other end-sides of the exhaust pipes 131 are coupled to each other to form one. The other end portion of the exhaust pipes 131 integrated into one is integrated with the housing of the turbine unit 114 of the supercharger 113. On the other hand, the exhaust pipe 131 and the housing of the turbine unit 114 may be formed as separate members and both members may be connected. Meanwhile, the muffler joint pipe 132 has one end-side connected to the turbine unit 114 of the supercharger 113 and the other end-side passing a lower-right side of the engine 12 and extending rearward toward the muffler. Also, the muffler is disposed at a rear-lower side of the engine 12. The exhaust gas discharged from the respective exhaust ports is supplied into the housing of the turbine unit 114 of the supercharger 113 via the exhaust pipes 131. By the exhaust gas, the turbine wheel of the turbine unit 114 is rotated. Subsequently, the exhaust gas discharged from the turbine unit 114 is supplied to the muffler via the muffler joint pipe 132 and is discharged from the muffler to the outside.

Also, the turbine unit 114 of the supercharger 113 is provided with a waste gate valve 133. That is, the turbine unit 114 is provided therein with a gate configured to circulate a part of the exhaust gas supplied via the exhaust pipes 131 toward the muffler joint pipe 132 without supplying the same to the turbine wheel-side. The waste gate valve 133 is configured to regulate an inflow amount of the exhaust gas to the turbine wheel-side by opening and closing the gate.

(Structure of Cooling System)

Also, as shown in FIG. 4 or 7, the cooling system has a water pump 29, a water jacket 32, a radiator 33 and a cooling water flow control unit 41.

The water pump 29 is a device configured to operate by using the rotation of the crankshaft and to discharge the cooling water to the water jacket 32.

The water jacket 32 is a mechanism provided in the cylinder 14 and the cylinder head 15 and configured to cool the cylinder 14 and the cylinder head 15 by the cooling water. The water jacket 32 is formed around a cylinder bore of the cylinder 14 or in the vicinity of an intake port and an exhaust port of the cylinder head 15.

The radiator 33 is a device configured to receive traveling wind or to drive a radiator fan 40, thereby radiating the heat of the cooling water to the atmosphere to cool the cooling water. The radiator 33 is disposed at the front of the engine 12. Also, the radiator 33 is a so-called transverse flow type radiator, and is configured to cool the cooling water by flowing the cooling water in a right-left direction (in the illustrative embodiment, from left to right) in the radiator 33. Also, as shown in FIG. 2, the radiator 33 has an upper radiator 34 and a lower radiator 35. The upper radiator 34 and the lower radiator 35 are connected to each other via a pair of connecting hoses 36. As shown in FIG. 7, a part of the cooling water delivered from the cooling water flow control unit 41 and introduced into a radiator inlet 37 provided at a left-upper side of a rear surface of the upper radiator 34 is cooled by the upper radiator 34, and then returns to the cooling water flow control unit 41 from a radiator outlet 38 provided at a right-upper side of the rear surface of the upper radiator 34. Also, the remaining of the cooling water introduced into the radiator inlet 37 of the upper radiator 34 is supplied to the lower radiator 35 through one connecting hose 36 and is cooled by the lower radiator 35, which then sequentially passes through the other connecting hose 36 and the radiator outlet 38 of the upper radiator 34 and returns to the cooling water flow control unit 41. Also, the radiator fan 40 is attached to the rear surface of the upper radiator 34.

The cooling water flow control unit 41 has functions of regulating an amount of the cooling water to flow in the radiator 33 in accordance with a temperature of the cooling water and maintaining the temperature of the cooling water to an appropriate temperature. That is, the engine unit 11 is formed with a first circulation path of the cooling water, which is to be discharged from the water pump 29, to flow in the water jacket 32 and to return to the water pump 29 without flowing in the radiator 33, and a second circulation path of the cooling water, which is to be discharged from the water pump 29, to flow in the water jacket 32 and the radiator 33 and to return to the water pump 29. The cooling water flow control unit 41 is configured to switch the first circulation path and the second circulation path in accordance with the temperature of the cooling water.

Figure 8:
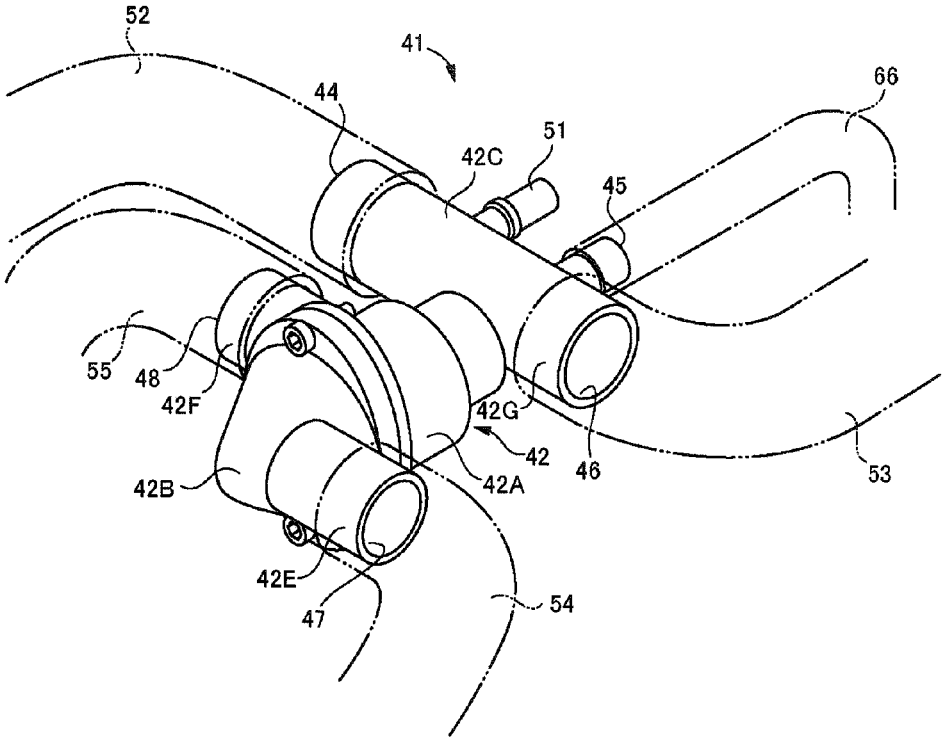
FIG. 8 illustrates a cooling water flow control unit of the motorcycle having a supercharger, which is the illustrative embodiment of the saddle-ridden type vehicle of the disclosure.
Figure 9:
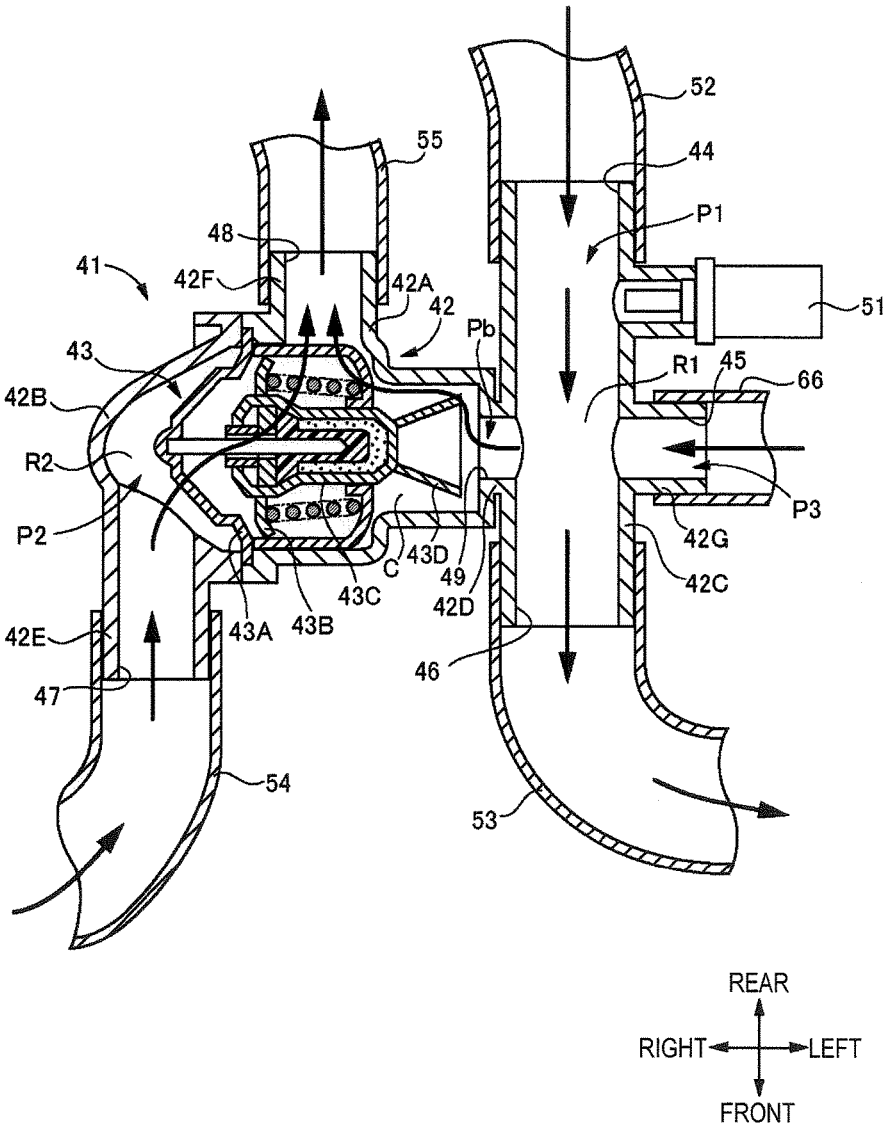
FIG. 9 illustrates an internal configuration and an operation of the cooling water flow control unit shown in FIG. 8.

FIG. 8 depicts an outward appearance of the cooling water flow control unit 41, and FIG. 9 depicts an inside of the cooling water flow control unit 41. As shown in FIG. 9, the cooling water flow control unit 41 has a thermostat housing 42 and a thermostat 43. The thermostat housing 42 is formed of a resin material or a metal material having heat resistance, for example. As shown in FIG. 8, the thermostat housing 42 has a cylindrical housing main body 42A, a cap part 42B fixed to a right side of the housing main body 42A by using a bolt or the like and configured to close the right side of the housing main body 42A, and a joint part 42C formed at a left side of the housing main body 42A. The joint part 42C has a cylindrical shape of which an axis line is perpendicular to an axis line of the housing main body 42A. Also, as shown in FIG. 9, the housing main body 42A and the joint part 42C are coupled via a coupling part 42D and are integrated. For example, the housing main body 42 and the joint part 42C are integrally formed by mold formation using a mold configured to have an integrated shape of the housing main body 42A and the joint part 42C. On the other hand, the housing main body 42 and the joint part 42C may be formed as separate members, and both members may be fitted and coupled.

Also, the thermostat housing 42 is formed with a first passage P1 through which the cooling water after cooling the engine 12 is to flow from the water jacket 32 to the radiator 33 and a second passage P2 through which the cooling water cooled by the radiator 33 is to flow from the radiator 33 to the water pump 29.

That is, a left chamber R1 serving as a first chamber is formed in a left part of the thermostat housing 42, i.e., in the joint part 42C. A left-rear side of the thermostat housing 42 is formed with a first cooling water inlet 44 for introducing the cooling water, which flows out from the water jacket 32 after cooling the engine 12, into the left chamber R1. Specifically, a rear opening of the joint part 42C is the first cooling water inlet 44. Also, a left-front side of the thermostat housing 42 is formed with a cooling water delivery port 46 for delivering the cooling water introduced into the left chamber R1 to the radiator 33. Specifically, a front opening of the joint part 42C is the cooling water delivery port 46. A passage configured by the first cooling water inlet 44, the left chamber R1 and the cooling water delivery port 46 is the first passage P1.

Also, a right chamber R2 serving as a second chamber is formed in a right part of the thermostat housing 42, i.e., in the housing main body 42A and the cap part 42B. Also, a right-front side of the thermostat housing 42 is formed with a cooling water return port 47 for introducing the cooling water, which flows out from the radiator 33 after being cooled by the radiator 33, into the right chamber R2. Specifically, a portion of a substantially conical peripheral wall part of the cap part 42B is formed with a tubular piping attachment part 42E protruding forward, and a front opening of the piping attachment part 42E is configured as the cooling water return port 47. Also, a right-rear side of the thermostat housing 42 is formed with a cooling water outlet 48 for returning the cooling water introduced into the right chamber R2 to the water pump 29. Specifically, a portion of a peripheral wall part of the housing main body 42A is formed with a tubular piping attachment part 42F protruding rearward, and a rear opening of the piping attachment part 42F is configured as the cooling water outlet 48. A passage configured by the cooling water return port 47, the right chamber R2 and the cooling water outlet 48 is the second passage P2.

Both the first passage P1 and the second passage P2 are integrally formed with the single thermostat housing 42 disposed above the engine 12, so that they are adjacent to each other.

Also, the first passage P1 and the second passage P2 are parallel with each other. That is, the joint part 42C extends straightly. For this reason, the first passage P1 extends straightly. Also, an extension direction (axial direction) of the piping attachment part 42E formed at the cap part 42B and an extension direction (axial direction) of the piping attachment part 42F formed at the housing main body 42A are parallel with each other and the piping attachment part 42E and the piping attachment part 42F are adjacent to each other. Therefore, it can be said that the second passage P2 also extends straightly, as seen from a substantial viewpoint. Also, an opening direction of the first cooling water inlet 44 and an opening direction of the cooling water outlet 48 are the same, and an opening direction of the cooling water delivery port 46 and an opening direction of the cooling water return port 47 are the same. For this reason, the extension direction of the first passage P1 and the extension direction of the second passage P2 are the same.

In the meantime, the thermostat housing 42 is formed with a third passage P3 for introducing the cooling water, which has flowed in the supercharger 113 or the oil cooler 26, into the first passage P1 so as to cool the supercharger 113 and the engine oil by the cooling water. Specifically, a left side of the left part of the thermostat housing 42 is formed with a second cooling water inlet 45 for introducing the cooling water, which has flowed in the oil cooler 26 or the supercharger 113, into the left chamber R1. Specifically, the peripheral wall part of the joint part 42C is formed with a tubular piping attachment part 42G protruding leftward, and a left opening of the piping attachment part 42G is configured as the second cooling water inlet 45. A passage ranging from the second cooling water inlet 45 to the left chamber R1 is the third passage P3.

Also, in the thermostat housing 42, a cooling water bypass passage Pb configured to communicate the first passage P1 and the second passage P2 each other is formed between the first passage P1 and the second passage P2. Specifically, a hole 49 configured to communicate the left chamber R1 and the right chamber R2 each other is formed in the coupling part 42D positioned between the left chamber R1 and the right chamber R2 in the thermostat housing 42. The hole 49 is the cooling water bypass passage Pb.

Also, the thermostat 43 is accommodated in the right chamber R2 of the thermostat housing 42. The thermostat 43 is configured to regulate a flow rate of the cooling water to flow in the radiator 33. Specifically, the thermostat 43 is configured to switch the first circulation path and the second circulation path in accordance with the temperature of the cooling water. That is, the thermostat 43 is configured to open and close the second passage P2 at a part (hereinafter, referred to as "upstream part of the second passage P2") of the second passage P2 positioned upstream of a connection part C between the second passage P2 and the cooling water bypass passage Pb in accordance with the temperature of the cooling water flowing in the right chamber R2. Also, the thermostat 43 is configured to open and close the cooling water bypass passage Pb in accordance with the temperature of the cooling water flowing in the right chamber R2.

As shown in FIG. 9, the thermostat 43 has a valve seat 43A, a main valve body 43B and a thermoelement 43C. The main valve body 43B is configured to open and close the upstream part of the second passage P2. The thermoelement 43C is configured to move the main valve body 43B relative to the valve seat 43A and to enable the main valve body 43B to be separated from or to be seated on the valve seat 43A in accordance with the temperature of the cooling water flowing in the right chamber R2. Specifically, the thermoelement 43C is configured to operate a spindle by using thermal expansion of wax enclosed in a pellet and to separate the main valve body 43B from the valve seat 43A against an urging force of a spring configured to urge the main valve body 43B in a direction of enabling the main valve body 43B to be seated on the valve seat 43A.

Also, the thermostat 43 is provided with a sub-valve body 43D. The sub-valve body 43D is configured to open and close the cooling water bypass passage Pb. Specifically, the sub-valve body 43D is fixed to a left part (a bottom part of the pellet) of the thermoelement 43C, and is configured to move together with the main valve body 43B in the same direction as the main valve body 43B. The sub-valve body 43D is configured to be separated from or to be seated on a part at which the cooling water bypass passage Pb opens toward the right chamber R2 of the thermostat housing 42.

On the other hand, a water temperature sensor 51 configured to detect the temperature of the cooling water flowing in the first passage P1 is attached to the joint part 42C of the thermostat housing 42.

Figure 10:
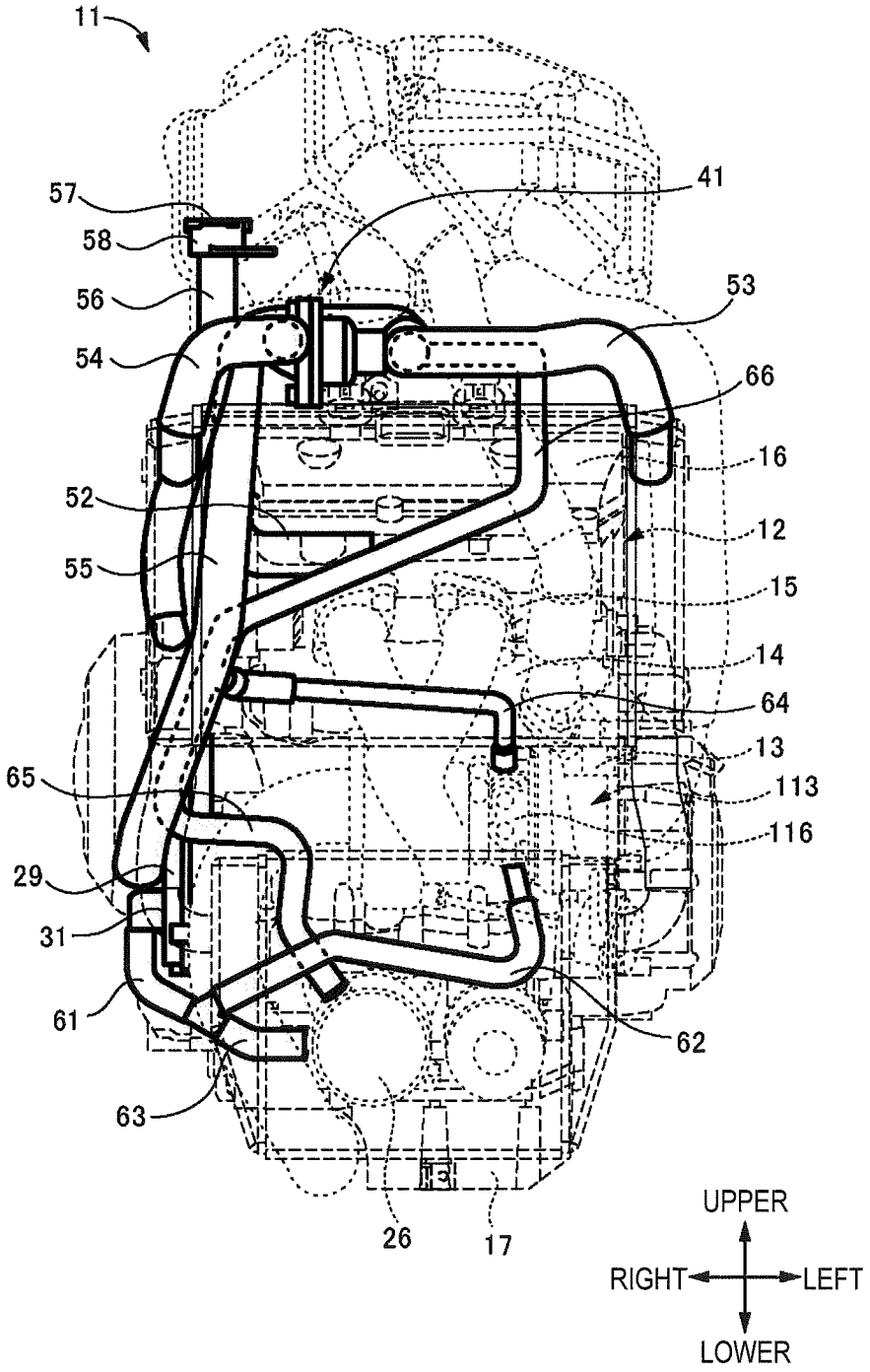
FIG. 10 illustrates arrangement of a water pump, the cooling water flow control unit and each cooling water piping in front of the engine unit of the motorcycle having a supercharger, which is the illustrative embodiment of the saddle-ridden type vehicle of the disclosure.
Figure 11:
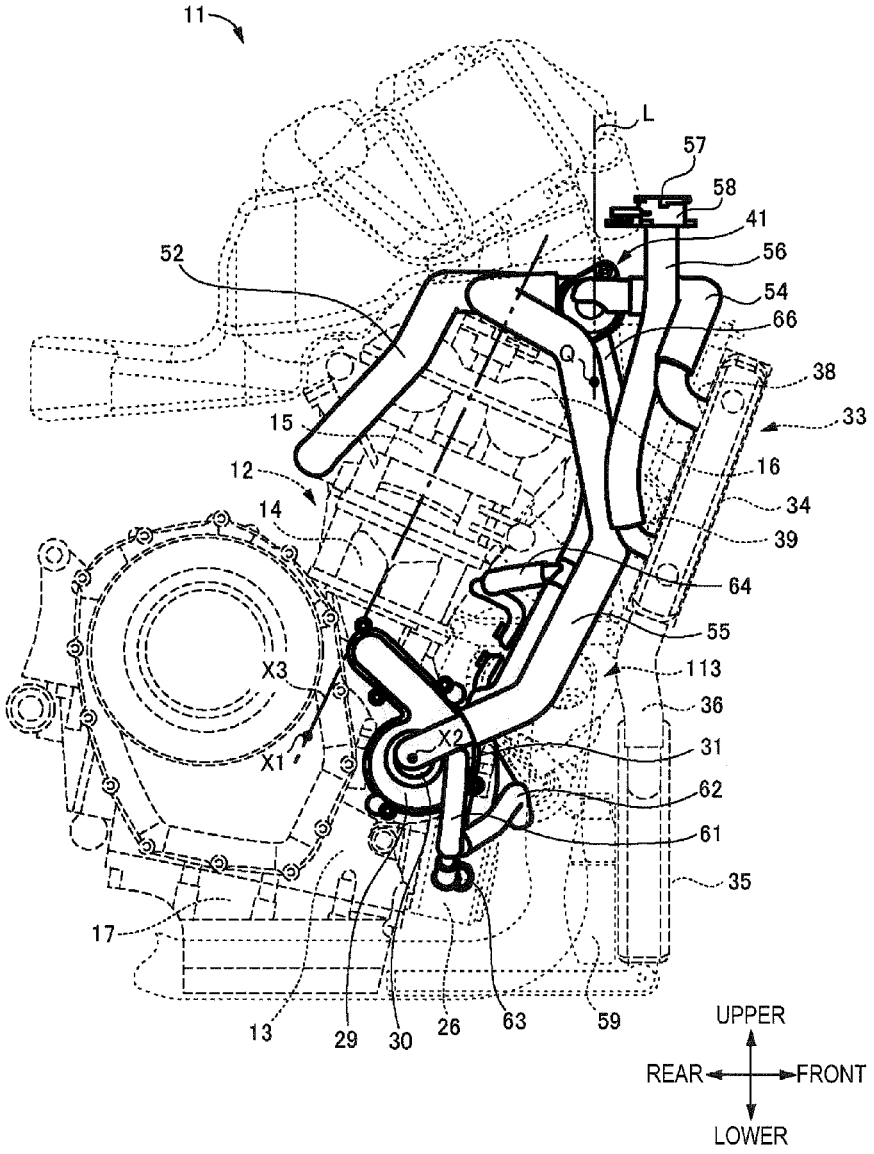
FIG. 11 illustrates the arrangement of the water pump, the cooling water flow control unit and each cooling water piping at a right surface of the engine unit of the motorcycle having a supercharger, which is the illustrative embodiment of the saddle-ridden type vehicle of the disclosure.

The respective parts configuring the cooling system are disposed and connected as follows. That is, FIGS. 10 and 11 depict arrangement of the water pump 29, the cooling water flow control unit 41 and the cooling water piping of the engine unit 11. In FIGS. 10 and 11, in order to clearly depict the arrangement of the water pump 29, the cooling water flow control unit 41 and the cooling water piping, the corresponding components are shown with the bold solid lines and the other components are shown with the thin broken lines. That is, as shown in FIG. 11, the water pump 29 is attached to the right side of the crank case 13. Also, the water pump 29 is disposed in front of the crankshaft. Specifically, the water pump 29 is disposed at a position corresponding to the balance shaft positioned in front of the crankshaft. Meanwhile, in FIG. 11, a reference numeral X1 indicates a shaft center of the crankshaft, and a reference numeral X2 indicates a shaft center of the balance shaft. Also, the water pump 29 (a backbone part of the water pump including at least a shaft part of an impeller) is disposed in front of an axis line X3 of the cylinder 14, when the engine 12 is seen from a side.

Also, a path (not shown) along which the cooling water is to be supplied from the water pump 29 to the water jacket 32 is formed between the water pump 29 and the water jacket 32. The corresponding path is formed in the crank case 13 and the like.

Also, the cooling water flow control unit 41 is disposed above the cylinder head cover 16. Also, the cooling water flow control unit 41 (a backbone part of the cooling water flow control unit 41 including at least the right chamber R2 and the thermostat 43) is disposed in front of the axis line X3 of the cylinder 14, when the engine 12 is seen from a side. Specifically, the cooling water flow control unit 41 is disposed above a front edge portion of an upper surface of the cylinder head cover 16. In the meantime, a position Q in FIG. 11 indicates a position of the front edge portion of the upper surface of the cylinder head cover 16. Also, a front end part of the cooling water flow control unit 41 is positioned in front of the front edge portion of the upper surface of the cylinder head cover 16. In the meantime, a line L in FIG. 11 indicates a position in a front-rear direction of the front edge portion of the upper surface of the cylinder head cover 16. Also, as shown in FIG. 7 or 10, the cooling water flow control unit 41 is disposed at the right of a center in a right-left direction of the engine 12, i.e., at the same side as a side at which the water pump 29 is disposed. In the meantime, although not shown, the cooling water flow control unit 41 is attached to a part (specifically, the main frame 213) of the vehicle body frame 211, for example.

Also, as shown in FIG. 7, an outlet 32A of the water jacket 32 and the first cooling water inlet 44 of the cooling water flow control unit 41 are connected therebetween by a cylinder outlet hose 52 serving as an engine outlet piping. The cylinder outlet hose 52 extends upward from a rear part of the engine 12 and then extends forward in a right region around the engine 12. Specifically, one end-side of the cylinder outlet hose 52 is connected to the outlet 32A of the water jacket 32 disposed at a rear part of the cylinder head 15 and at a position toward the slight right side of a central portion in the right-left direction of the cylinder head 15. Also, the other end-side of the cylinder outlet hose 52 extends rightward at the rear of the cylinder head 15 from the position at which the outlet 32A of the water jacket 32 is disposed, extends upward with being curved at a place beyond the right surface of the cylinder head 15, as shown in FIG. 11, is curved at a place beyond an upper surface of the cylinder head cover 16, extends leftward above the cylinder head cover 16, as shown in FIG. 7, extends forward with being curved at a position above the cylinder head cover 16 and toward the slight right side of the central portion in the right-left direction of the cylinder head 15, reaches the first cooling water inlet 44 of the cooling water flow control unit 41 and is then connected to the first cooling water inlet 44.

Also, the cooling water delivery port 46 of the cooling water flow control unit 41 and the radiator inlet 37 of the upper radiator 34 are connected therebetween by a radiator inlet hose 53 serving as a radiator inlet piping. The radiator inlet hose 53 extends in a left-front direction above a space between the engine 12 and the radiator 33 in a region ranging from a right side to a left side around the engine 12. Specifically, as shown in FIG. 7, one end-side of the radiator inlet hose 53 is connected to the cooling water delivery port 46 disposed at a position above the cylinder head cover 16 and toward the slight right side of a central portion in the right-left direction of the cylinder head cover 16. Also, the other end-side of the radiator inlet hose 53 extends forward from the position at which the cooling water delivery port 46 is disposed, is curved before reaching the upper radiator 34, extends leftward, comes close to a left end portion of the upper radiator 34 and is curved, as shown in FIG. 10, extends downward, reaches the radiator inlet 37 positioned at the left end portion of the upper radiator 34 and is connected to the radiator inlet 37, as shown in FIG. 7.

Also, the radiator outlet 38 of the upper radiator 34 and the cooling water return port 47 of the cooling water flow control unit 41 are connected therebetween by a radiator outlet hose 54 serving as a radiator outlet piping. The radiator outlet hose 54 extends rearward above the space between the engine 12 and the radiator 33 in the right region around the engine 12. Specifically, as shown in FIG. 7, one end-side of the radiator outlet hose 54 is connected to the radiator outlet 38 disposed at a right end portion of the upper radiator 34. Also, the other end-side of the radiator outlet hose 54 extends upward from the position at which the radiator outlet 38 is disposed, as shown in FIG. 11, is curved and extends leftward over a short distance, as shown in FIG. 7, is curved and extends rearward over a short distance, reaches the cooling water return port 47 disposed at an upper-right side of the cylinder head cover 16 and is connected to the cooling water return port 47.

Also, the cooling water outlet 48 of the cooling water flow control unit 41 and a cooling water intake port 30 of the water pump 29 are connected therebetween by a water pump inlet hose 55 serving as a water pump inlet piping. The water pump inlet hose 55 extends downward between the engine 12 and the radiator 33 in the right region around the engine 12. Specifically, as shown in FIG. 7, one end-side of the water pump inlet hose 55 is connected to the cooling water outlet 48 disposed at the upper-right side of the cylinder head cover 16. Also, the other end-side of the water pump inlet hose 55 extends rearward over a short distance from the position at which the cooling water outlet 48 is disposed, is curved rightward by about 180°, extends forward as shown in FIG. 11, is slightly curved, extends in a front-lower direction between the cylinder head cover 16 and the upper radiator 34, is slightly curved, extends in a rear-lower direction (a direction along the inclined cylinder axis line) between the cylinder head 15 and the upper radiator 34, is further slightly curved, extends in a rear-lower direction, reaches the cooling water intake port 30 of the water pump 29 and is connected to the cooling water intake port 30.

Also, as shown in FIG. 11, a right-lower side of the rear surface of the upper radiator 34 is formed with a cooling water supply port 39, the cooling water supply port 39 is connected with a lower end portion of a water injection hose 56 extending in the upper-lower direction, and an upper end portion of the water injection hose 56 is provided with a cooling water injection part 58 having a cooling water injection port 57. Also, a reservoir tank 59 configured to reserve therein the cooling water is provided at the rear of the lower radiator 35, and the reservoir tank 59 is connected to the upper radiator 34 via an overflow pipe line (not shown), for example.

Also, the cooling system of the engine unit 11 has the configurations of supplying the cooling water to the oil cooler 26 and the supercharger 113, cooling the engine oil at the oil cooler 26 and cooling the bearing unit 116 of the supercharger 113. Specifically, as shown in FIG. 11, the water pump 29 has a cooling water discharge port 31 configured to supply the cooling water to the outside of the engine, in addition to a cooling water discharge port (not shown) configured to supply the cooling water to the water jacket 32. The cooling water discharge port 31 is connected with one end-side of a common inlet piping 61, and the other end-side of the common inlet piping 61 is connected with one end-side of a supercharger inlet piping 62 and one end-side of an oil cooler inlet piping 63 via a joint having one inlet and two outlets, respectively. Also, as shown in FIG. 10, the other end-side of the supercharger inlet piping 62 is connected to a cooling water inlet provided in the bearing unit 116 of the supercharger 113. Also, the other end-side of the oil cooler inlet piping 63 is connected to a cooling water inlet provided in the oil cooler 26. Also, a cooling water outlet provided in the bearing unit 116 of the supercharger 113 is connected with one end-side of a supercharger outlet piping 64, and a cooling water outlet provided in the oil cooler 26 is connected with one end-side of an oil cooler outlet piping 65. Also, the other end-side of the supercharger outlet piping 64 and the other end-side of the oil cooler outlet piping 65 are connected to one end-side of a common outlet piping 66 via a joint having two inlets and one outlet. Also, as shown in FIG. 7, the other end-side of the common outlet piping 66 is connected to the second cooling water inlet 45 of the cooling water flow control unit 41. As shown in FIG. 11, the common inlet piping 61, the supercharger inlet piping 62, the oil cooler inlet piping 63, the supercharger outlet piping 64, the oil cooler outlet piping 65 and the common outlet piping 66 are all disposed between the engine 12 and the radiator 33. In the meantime, the common inlet piping 61, the supercharger inlet piping 62 and the oil cooler inlet piping 63 are specific examples of an inlet branch pipeline, and the supercharger outlet piping 64, the oil cooler outlet piping 65 and the common outlet piping 66 are specific examples of an outlet branch piping.

Figure 12:
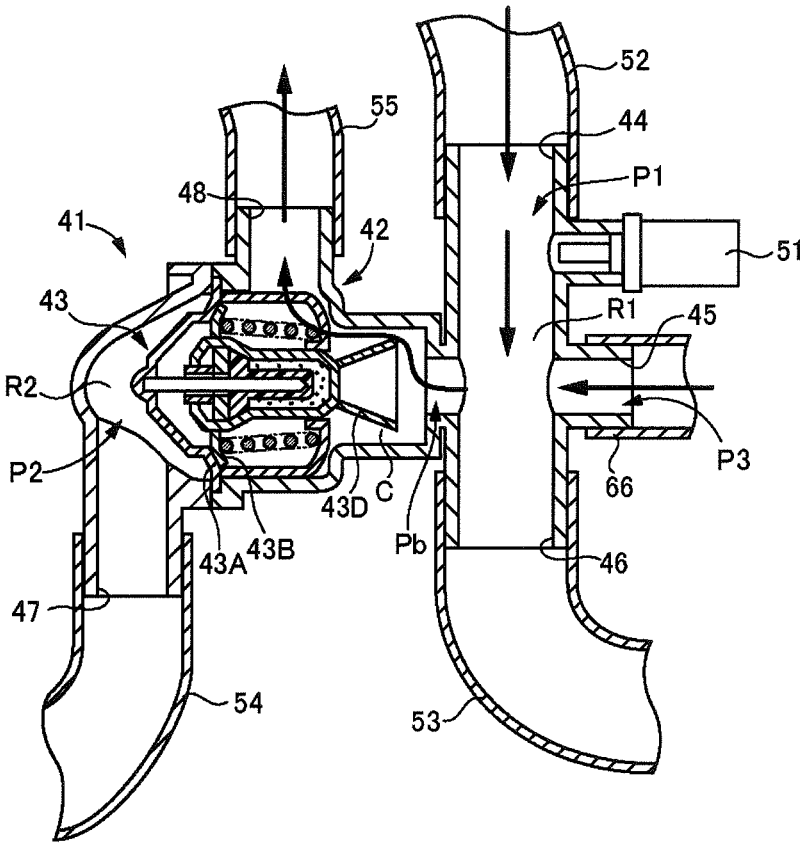
FIG. 12 illustrates the operation of the cooling water flow control unit shown in FIG. 8.

In the cooling system of the engine 12 having the above-described configuration, a flowing path of the cooling water in accordance with the temperature of the cooling water is described with reference to FIGS. 9, 12 and 13. FIG. 12 depicts a flowing path of the cooling water when the temperature of the cooling water flowing in the right chamber R2 of the cooling water flow control unit 41 is equal to or lower than a predetermined reference temperature T1, FIG. 9 depicts a flowing path of the cooling water when the temperature of the cooling water flowing in the right chamber R2 is higher than the reference temperature T1 and is equal to or lower than a predetermined reference temperature T2 (T2>T1), and FIG. 13 depicts a flowing path of the cooling water when the temperature of the cooling water flowing in the right chamber R2 is higher than the reference temperature T2.

In FIG. 12, when the water pump 29 starts to drive as the engine 12 starts, the cooling water is supplied from the water pump 29 to the water jacket 32. The cooling water, which has flowed in the water jacket 32 and has cooled the engine 12, is introduced into the left chamber R1 through the cylinder outlet hose 52 from the first cooling water inlet 44 of the cooling water flow control unit 41 and is also introduced into the right chamber R2 through the cooling water bypass passage Pb. The thermostat 43 completely closes the upstream part of the second passage P2 and completely opens the cooling water bypass passage Pb when the temperature of the cooling water flowing in the right chamber R2 is equal to or lower than the reference temperature T1. Thereby, the cooling water introduced into the left chamber R1 from the first cooling water inlet 44 sequentially flows in the cooling water bypass passage Pb, the right chamber R2 and the cooling water outlet 48 from the left chamber R1, and returns to the water pump 29 through the water pump inlet hose 55. At this time, since the cooling water does not flow in the radiator 33 (the cooling water having flowed out from the radiator outlet 38 does not circulate in the second passage P2), the cooling water is not cooled by the radiator 33. The corresponding circulation path of the cooling water is formed upon a warm-up operation of the engine 12, for example. In this way, only the cooling water not cooled by the radiator 33 is enabled to circulate, so that it is possible to warm the engine 12 in a short time upon the warm-up operation.

In the meantime, as shown in FIG. 9, when the temperature of the cooling water flowing in the right chamber R2 is higher than the reference temperature T1 and is equal to or lower than the reference temperature T2, the thermostat 43 opens both the upstream part of the second passage P2 and the cooling water bypass passage Pb. Then, the thermostat 43 increases a flow path area of the upstream part of the second passage P2 and reduces a flow path area of the cooling water bypass passage Pb as the temperature of the cooling water flowing in the right chamber R2 increases. Thereby, the cooling water introduced into the left chamber R1 from the first cooling water inlet 44 is split in the left chamber R1 into the cooling water to flow in the cooling water bypass passage Pb and to be introduced into the right chamber R2 and the cooling water to sequentially flow in the cooling water delivery port 46, the radiator inlet hose 53, the radiator 33, the radiator outlet hose 54 and the cooling water return port 47 and to be introduced into the right chamber R2. The cooling water having flowed in the radiator 33 is cooled by the radiator 33. Also, the cooling waters having flowed in the two paths converge at the right chamber R2, which then returns from the cooling water outlet 48 to the water pump 29 through the water pump inlet hose 55. Also, in this case, as the temperature of the cooling water flowing in the right chamber R2 increases, an amount of the cooling water flowing in the radiator 33 relative to an amount of the cooling water flowing in the cooling water bypass passage Pb increases. In this way, the mixed cooling water of the cooling water not cooled at the radiator 33 and the cooling water cooled at the radiator 33 is enabled to circulate, so that it is possible to suppress a rapid change in the temperature of the cooling water and to stabilize the cooling of the engine 12.

Figure 13:
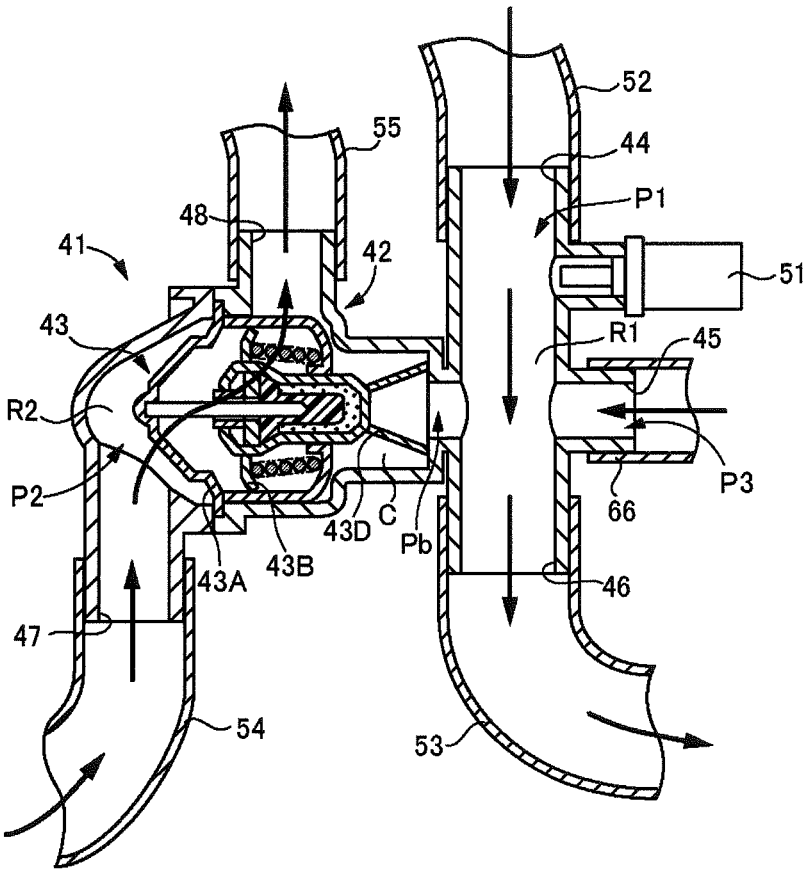
FIG. 13 illustrates the operation of the cooling water flow control unit shown in FIG. 8.

On the other hand, as shown in FIG. 13, when the temperature of the cooling water flowing in the right chamber R2 is higher than the reference temperature T2, the thermostat 43 completely opens the upstream part of the second passage P2 and completely closes the cooling water bypass passage Pb. Thereby, the cooling water introduced into the left chamber R1 from the first cooling water inlet 44 sequentially flows in the cooling water delivery port 46, the radiator inlet hose 53, the radiator 33, the radiator outlet hose 54, the cooling water return port 47, the right chamber R2 and the cooling water outlet 48 from the left chamber R1, and returns to the water pump 29 through the water pump inlet hose 55. When the engine 12 and the cooling water become at high temperatures, the corresponding circulation path of the cooling water is formed. In this way, only the cooling water cooled by the radiator 33 is enabled to circulate, so that it is possible to rapidly lower the temperature of the engine 12.

Also, as the water pump 29 is driven, the cooling water is supplied from the cooling water discharge port 31 of the water pump 29 to the supercharger 113 and the oil cooler 26 through the common inlet piping 61, the supercharger inlet piping 62 and the oil cooler inlet piping 63, respectively. The cooling water having cooled the supercharger 113 and the engine oil is introduced into the left chamber R1 from the second cooling water inlet 45 of the cooling water flow control unit 41 via the supercharger outlet piping 64, the oil cooler outlet piping 65 and the common outlet piping 66 from the supercharger 113 and the oil cooler 26, and converges with the cooling water introduced into the left chamber R1 through the first cooling water inlet 44 from the water jacket 32.

As described above, according to the motorcycle 1, which is an illustrative embodiment of the saddle-ridden type vehicle of the disclosure, the water pump 29 is disposed in front of the crankshaft and the cooling water flow control unit 41 is disposed above the cylinder head cover 16. Therefore, almost all parts of the radiator inlet hose 53 and the radiator outlet hose 54 can be easily disposed between the engine 12 and the radiator 33. Also, the water inlet hose 55 extends in the upper-lower direction from the cooling water flow control unit 41 disposed above the cylinder head cover 16 to the water pump 29 disposed at the right-front side of the crankshaft 13. Thereby, most of the water inlet hose 55, i.e., a part except for both end portions of the water pump inlet hose 55 can be easily disposed between the engine 12 and the radiator 33. Therefore, the radiator inlet hose 53, the radiator outlet hose 54 and the water pump inlet hose 55 can be concentrated in front of the engine 12, i.e., in the space between the engine 12 and the radiator 33. For this reason, it is possible to prevent the radiator inlet hose 53, the radiator outlet hose 54 or the water pump inlet hose 55 from traversing laterally the engine 12. Therefore, it is possible to expose a wide range of the side surface of the engine 12, so that it is possible to improve a design property of the motorcycle 1.

Also, the radiator inlet hose 53, the radiator outlet hose 54 and the water pump inlet hose 55 are concentrated in the space between the engine 12 and the radiator 33, so that it is possible to easily conceal the hoses by the radiator cover and the like. As a result, it is possible to improve an outward appearance of the motorcycle 1.

Also, the radiator inlet hose 53, the radiator outlet hose 54 and the water pump inlet hose 55 are concentrated in the space between the engine 12 and the radiator 33, so that it is possible to reduce a vehicle width of the motorcycle 1. As a result, it is possible to improve a handling property of the motorcycle 1. Also, since the cooling wind can collide well with the side surface of the engine 12, it is possible to improve cooling performance of the engine 12. Also, since it is possible to form a large empty space at the side of the engine 12, it is possible to easily secure an arrangement space of the components to be provided in the engine 12.

Also, according to the motorcycle 1, the cooling water flow control unit 41 is disposed in front of the cylinder axis line X3, when the engine 12 is seen from a side. Specifically, the cooling water flow control unit 41 is disposed above the front edge portion of the cylinder head cover 16. Thereby, it is possible to bring the cooling water flow control unit 41 close to the space between the engine 12 and the radiator 33. Therefore, it is possible to easily concentrate the radiator inlet hose 53, the radiator outlet hose 54 and the water pump inlet hose 55 between the engine 12 and the radiator 33, so that it is possible to increase a degree of the concentrated arrangement. Also, it is possible to shorten the radiator inlet hose 53, the radiator outlet hose 54 and the water pump inlet hose 55.

Also, the water pump 29 is disposed in front of the cylinder axis line X3, when the engine 12 is seen from a side. Therefore, it is possible to limit a part of the water inlet hose 55, which protrudes to the right side of the crank case 13 at a downstream end-side, simply by a slight front part of the crank case 13. Also, it is possible to easily dispose the water inlet hose 55 between the engine 12 and the radiator 33 and to shorten the radiator inlet hose 55.

Also, the water pump 29 and the cooling water flow control unit 41 are all disposed at the right side of the center in the right-left direction of the engine 12. Therefore, it is possible to concentrate the cylinder outlet hose 52, the radiator outlet hose 54 and the water pump inlet hose 55 in the right region around the engine 12. Thereby, it is possible to form a large empty space in the left region around the engine 12, so that it is possible to easily secure an arrangement space of the components to be provided in the engine 12. For example, the components of the intake system such as the air intake pipe 125, the air outlet pipe 126 and the like, which are required as the supercharger 113 is provided, can be concentrated in the left region of the engine 12.

Also, the water pump 29 is disposed in front of the crankshaft and the cooling water flow control unit 41 is disposed above the cylinder head cover 16. Therefore, it is possible to easily dispose the common inlet piping 61, the supercharger inlet piping 62, the oil cooler inlet piping 63, the supercharger outlet piping 64, the oil cooler outlet piping 65 and the common outlet piping 66 for cooling the supercharger 113 and the engine oil between the engine 12 and the radiator 33 and to concentrate the corresponding pipings together with the radiator inlet hose 53, the radiator outlet hose 54 and the water pump inlet hose 55. Also, since the water pump 29 and the cooling water flow control unit 41 are disposed in front of the cylinder axis line X3, when the engine 12 is seen from a side, it is possible to increase the degree of the concentrated arrangement of the pipings for cooling the supercharger 113 and the engine oil.

Also, as shown in FIG. 9, in the cooling water flow control unit 41, the thermostat 43 is provided with the sub-valve body 43D, and the cooling water bypass passage Pb is completely closed by the sub-valve body 43D when the temperature of the cooling water is higher than the reference temperature T2. Thereby, when the engine 12 reaches the high temperatures, only the cooling water cooled by the radiator 33 is enabled to flow in the water jacket and the like, so that it is possible to rapidly lower the temperature of the engine 12. Also, when the temperature of the cooling water is higher than the reference temperature T2, the cooling water bypass passage Pb is completely closed by the sub-valve body 43D. Therefore, even though a passage diameter of the cooling water bypass passage Pb is made large or a passage length is shortened, the cooling effect of the engine 12 is not lowered when the engine 12 reaches the high temperatures. For this reason, it is possible to reduce a passage resistance of the cooling water bypass passage by enlarging the passage diameter of the cooling water bypass passage Pb or shortening the passage length. Thereby, when the engine 12 is at low temperatures, i.e., while the cooling water bypass passage is completely opened, it is possible to increase the warming-up performance of the engine 12.

However, in the cooling water flow control unit 41, a thermostat having no sub-valve body may be adopted. In this case, the cooling water bypass passage Pb is opened all the time. Also, when the engine 12 is at high temperatures, it is not possible to flow only the cooling water cooled by the radiator 33 through the water jacket 32 and the like but it is possible to save the manufacturing cost and to simplify the structure of the cooling water flow control unit 41.

Meanwhile, in the above illustrative embodiment, the water pump 29 and the cooling water flow control unit 41 are all disposed at the right side of the engine 12. However, the water pump 29 and the cooling water flow control unit 41 may be all disposed at the left side of the engine 12. In this case, the arrangement of the air cleaner 111, the supercharger 113, the intercooler 117 and the like is preferably reversed with respect to the right-left direction.

Also, the disclosure can be applied to a saddle-ridden type vehicle having no supercharger. Also, the engine of the saddle-ridden type vehicle of the disclosure is not limited to the parallel two-cylinder four-cycle gasoline engine as described in the illustrative embodiment. Also, the disclosure can be applied to a saddle-ridden type vehicle having a general unified radiator, which is not divided into an upper radiator and a lower radiator. Also, the saddle-ridden type vehicle of the disclosure is not limited to the motorcycle, and can be applied to a variety of saddle-ridden type vehicles such as a three-wheeled vehicle, a buggy car or the like having an engine.

Also, the disclosure can be appropriately changed without departing from the gist or spirit of the inventions that can be understood from the claims and the entire specification, and a saddle-ridden type vehicle having the change is also included in the technical spirit of the disclosure.

What is claimed is:

1. A saddle-ridden type vehicle comprising:

an engine in which a cylinder and a cylinder head are provided above a crank case and a cylinder head cover is provided above the cylinder head;

a water pump configured to discharge cooling water;

a water jacket provided in the engine and configured to cool the engine by the cooling water discharged from the water pump;

a radiator disposed in front of the engine and configured to cool the cooling water having cooled the engine;

a cooling water flow control unit having a first passage through which the cooling water having cooled the engine flows from the water jacket to the radiator, a second passage through which the cooling water having flowed in the radiator flows from the radiator to the water pump, a bypass passage communicating the first passage and the second passage each other and a thermostat configured to control a flow rate of the cooling water flowing in the radiator;

an engine outlet piping connecting an outlet of the water jacket and an inlet of the first passage of the cooling water flow control unit therebetween;

a radiator inlet piping connecting an outlet of the first passage of the cooling water flow control unit and an inlet of the radiator therebetween;

a radiator outlet piping connecting an outlet of the radiator and an inlet of the second passage of the cooling water flow control unit therebetween; and a water pump inlet piping connecting an outlet of the second passage of the cooling water flow control unit and an intake port of the water pump therebetween, wherein the water pump is disposed at a side part of the crank case and in front of a crankshaft of the engine, wherein the cooling water flow control unit is disposed above the cylinder head cover, and wherein the radiator inlet piping, the radiator outlet piping and the water pump inlet piping are concentrated in a space between the engine and the radiator.

2. The saddle-ridden type vehicle according to claim 1, wherein the cooling water flow control unit is disposed above a front edge portion of an upper surface of the cylinder head cover.

3. The saddle-ridden type vehicle according to claim 1, wherein the cooling water flow control unit is disposed in front of an axis line of the cylinder, when the engine is seen from a side.

4. The saddle-ridden type vehicle according to claim 1, wherein the water pump is disposed in front of an axis line of the cylinder, when the engine is seen from a side.

5. The saddle-ridden type vehicle according to claim 1, wherein the water pump and the cooling water flow control unit are both disposed at one side deviating from a center of the engine in a right-left direction.

6. The saddle-ridden type vehicle according to claim 1, wherein a supercharger or an oil cooler is provided at the front of the engine, wherein a discharge port of the water pump and a cooling water inlet of the supercharger or the oil cooler are connected by an inlet branch piping, wherein a cooling water outlet of the supercharger or the oil cooler and the inlet of the first passage of the cooling water flow control unit are connected by an outlet branch piping, and wherein the inlet branch piping and the outlet branch piping are disposed between the engine and the radiator.

* * * * *